US011649739B2

(12) United States Patent
Hodgkinson et al.

(10) Patent No.: US 11,649,739 B2
(45) Date of Patent: May 16, 2023

(54) VALVE BRIDGE CONSTRAINTS AND GUIDES AND RELATED METHODS

(71) Applicant: Jacobs Vehicle Systems, Inc., Bloomfield, CT (US)

(72) Inventors: Eric J. Hodgkinson, New Hartford, CT (US); Timothy P. Neal, Harwinton, CT (US); Justin D. Baltrucki, Canton, CT (US); G. Michael Gron, Jr., Windsor, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 17/812,063

(22) Filed: Jul. 12, 2022

(65) Prior Publication Data

US 2023/0007897 A1 Jan. 12, 2023

Related U.S. Application Data

(60) Provisional application No. 63/203,182, filed on Jul. 12, 2021.

(51) Int. Cl.
*F01L 1/26* (2006.01)
*F01L 13/06* (2006.01)

(52) U.S. Cl.
CPC ..... *F01L 1/26* (2013.01); *F01L 13/06* (2013.01)

(58) Field of Classification Search
CPC ..... F01L 1/26; F01L 13/06
USPC ..... 123/90.22, 90.4
See application file for complete search history.

(56) References Cited

U.S. PATENT DOCUMENTS

2012/0024260 A1 2/2012 Groth et al.
2013/0098319 A1* 4/2013 Methley ..... F01L 1/14 123/90.12
2014/0326212 A1 11/2014 Baltrucki et al.
2020/0003085 A1* 1/2020 Baltrucki ..... F01L 13/0005
2020/0141287 A1* 5/2020 Gron, Jr. ..... F01L 1/18

FOREIGN PATENT DOCUMENTS

JP H07301107 A 11/1995
JP 2016169607 A 9/2016

OTHER PUBLICATIONS

International Search Report for International Application No. PCT/IB2022/056436 dated Oct. 11, 2022, 3 pages.
Written Opinion of the International Searching Authority for International Application No. PCT/IB2022/056436 dated Oct. 11, 2022, 3 pages.

* cited by examiner

*Primary Examiner* — Jorge L Leon, Jr.
(74) *Attorney, Agent, or Firm* — Moreno IP Law LLC

(57) ABSTRACT

Valve bridge systems include constraints and guides for managing bridge jump and other uncontrolled valve bridge motion during engine operation. Constraints may include an e-foot collar, an extended portion on the bridge, and a bridge brake pin. Guides may include valve stem tip lead-in chamfers surrounding the valve bridge valve pockets as well as a deflection surface on the bridge extended portion. Methods of configuring valve bridges may include configuring the valve step tip lead-in chamfers based on worst-case positions of the valve bridge defined by one or more or a combination of the constraints provided by the e-foot collar, extended portion and brake pin.

24 Claims, 13 Drawing Sheets

VALVE BRIDGE CONSTRAINTS AND GUIDES AND RELATED METHODS

FIELD

The instant disclosure relates generally to valve actuation systems in internal combustion engines, and in particular to valve bridge systems comprising constraints and guides for managing bridge jump and other uncontrolled valve bridge motion during engine operation. Constraints may include an e-foot collar, an extended portion having a lower guide surface on the bridge, and a bridge brake pin. Guides may include valve stem tip lead-in chamfers surrounding the valve bridge valve pockets as well as a deflection surface on the bridge extended portion. The instant disclosure also relates generally to methods of configuring valve bridges with constraints and guides.

BACKGROUND

Valve actuation systems for use in internal combustion engines are well known in the art. Such valve actuation systems typically include a valve train that, in turn, comprises one or more components that transfer valve actuation motions from a valve actuation motion source (e.g., one or more cams) to an engine valve. FIG. 1 illustrates a typical exhaust valve actuation subsystem in a prior art valve actuation system having a lost motion valve bridge 600/700. It will be understood that similar components may be used to implement actuation of intake valves. A main exhaust rocker arm 100/400 may be pivotally mounted and adapted to rotate about a rocker shaft 110. A motion follower 120 may be disposed at one end of the main exhaust rocker arm 100/400 and may contact and follow a motion source (i.e., rotating cam 260) to impart motion to the rocker. The cam 260 may be controlled with a controller 265 and may include a single main exhaust bump 262 (or a main intake bump in the case of an intake valve actuation system). As is well-known in the art, hydraulic fluid may be supplied to the rocker arm 100/400 from a hydraulic fluid supply (not shown) under the control of a solenoid hydraulic control valve (not shown). The hydraulic fluid may flow through a passage 510 formed in the rocker shaft 110 to a hydraulic passage 215 formed within the rocker arm 100/400. A return or auxiliary passage 520 may also be formed in the rocker shaft.

Still referring to FIG. 1, a swivel foot, also commonly referred to as an elephant foot or e-foot 240, may be part of a screw assembly 230 disposed at one end of the rocker arm 100/400 to convey motion from the rocker arm 100/400 to the valve bridge 710, which spans two or more engine valves 810/890 and 820/920 associated with a given cylinder. In many cases, such valve bridges permit another component of a valve train (e.g., a rocker arm) to simultaneously actuate the engine valves engaged with the valve bridge through a brake pin 650/700 disposed in a bore 714. The position of the swivel foot 240 relative to the rocker arm 100/400 may be adjusted using an adjusting screw 232 secured with a threaded fastener 234 which thereby provides adjustment of lash (i.e., space between the swivel foot 240 and valve bridge 710). A hydraulic passage 235 in communication with the rocker passage 215 may be formed in the screw 232 to convey fluid from the rocker passage 215 to the valve bridge. The swivel foot 240 may contact the lost motion valve bridge 600/700. The exhaust valve bridge 600/700 may include a valve bridge body 710 having a central opening 712 extending through the valve bridge and a side opening 714 extending through a first end of the valve bridge. The side opening 714 may receive a sliding pin 650 which contacts the valve stem of a first exhaust valve 810. The valve stem of a second exhaust valve 820 may contact the other end of the exhaust valve bridge.

Ideally, in operation, opposition of forces applied by a motion-conveying component (such as a rocker arm) and by engine valve springs ensures that a valve bridge remains in contact (with allowances for normal lash settings) simultaneously with the motion-conveying component and with the engine valves. In this manner, the valve bridge is consistently maintained in alignment with, and positioned to convey valve actuation motions to, the engine valves. As used herein, this state of the valve bridge is referred to as a "controlled state" of the valve bridge relative to the engine valves.

Some valve actuation systems are configured to provide so-called auxiliary valve actuation motions, i.e., valve actuation motions other than or in addition to the valve actuation motions used to operate an engine in a positive power production mode through the combustion of fuel. In such valve actuation systems, a valve train component (e.g., tappet, pushrod, rocker arm, valve bridge, etc.) may be configured to include devices or lost motion assemblies that permit valve actuation motions to be transmitted through the valve train component to the engine valves, or selectively "lost" where such motions are not transmitted through the valve train component to the engine valves. The signal to activate or deactivate the lost motion assembly and thereby cause the lost motion assembly to absorb or convey motion may be provided via hydraulic (oil) pressure controlled by an upstream solenoid valve. FIG. 1 illustrates an example of such a system described in U.S. Patent Application Publication No. 2012/0024260, the teachings of which are incorporated herein by this reference. In this case, a valve bridge assembly 600/700 is provided with a lost motion assembly in the form of a locking mechanism. The central opening 712 of the exhaust valve bridge 600 may receive a lost motion or locking assembly including an outer plunger 720 disposed in an outer plunger bore 722, a cap 730 disposed in the outer plunger 720, an inner plunger 760, an inner plunger spring 744, an outer plunger spring 746, and one or more wedge rollers or balls 740. The swivel foot 240 engages the cap 730 and thus conveys motion to the outer plunger 720 and ultimately to the bridge 600 and valves if the outer plunger 720 is locked relative to the bridge 600. In the illustrated embodiment, the locking mechanism ball 740 may be located in an inner plunger recess 762 and upon upward motion of the inner plunger 760 be forced through an opening in an outer plunger 720 and into engagement with a recess 770 formed in the body of the valve bridge. In this state, the ball 740 is prevented from disengaging the recess 770 due to an outer diameter of the inner plunger 760, thereby locking the outer plunger 720 into a fixed relationship relative to the valve bridge 710. Consequently, any valve actuation motions applied to the outer plunger 720 by a rocker arm 100/400 is conveyed to the valve bridge 710 and to the engine valves 810/910, 820/920. However, when a recess formed in the inner plunger 760 is aligned with ball 740, the ball is free to disengage the recess 770 in the valve bridge 710, thereby unlocking the outer plunger 720 and allowing it to reciprocate relative to the valve bridge 710. In this state, any valve actuation motions applied to the outer plunger 720 cause the outer plunger to move within the valve bridge 710 and are not conveyed to the engine valves. Another valve bridge-based locking/unlocking system is disclosed in U.S. Patent Application Publication No. 2014/0326212, the teachings of which are incorporated herein by this reference.

However, in systems of the type illustrated in FIG. 1, the possibility exists for partial engagement of the locking mechanism, particularly in the operational environment when the valve bridge is reciprocating rapidly and under high loads. Partial engagement may occur, for example, where the inner plunger or latch piston in prior art systems such as those described above moves out of full engagement with the ball or wedge elements. In this case, it is possible during the rapid changing in loading and high-speed vibration of the bridge and other valve train components during engine operation for slippage of the locking mechanism. Partial engagement and slippage of the locking mechanism may occur after valve normal actuation motion (i.e., valve opening motion) is initially applied by the bridge to the engine valves. Slippage after such initial motion may result in rapid release of valve spring energy as one or both of the engine valves slam closed against their respective valve seats. When this happens, the force provided by the valve actuation components to open the engine valves is suddenly removed, permitting the engine valves to rapidly accelerate to a closed position in an unrestrained manner under the considerable force of the valve springs. When the engine valves reach the fully closed position (i.e., stopped against the valve seats formed in the cylinder head), the momentum of the valve bridge may cause the valve bridge to "jump" from the valve stem tips. That is, the valve bridge will continue movement in an uncontrolled manner and generally in a direction away from and/or out of alignment with one or both of the engine valve stems. Such motion may create potential for collision of the valve bridge with the rocker arm or other component in the valve train or engine cylinder head environment. In extreme circumstances it may be possible for the valve bridge to completely jump off of one or both of the valve stem tips and remain dislodged from the engine valves, thereby causing engine failure and/or damage. It is also known for uncontrolled states of valve bridges to occur because of overspeed operation of an internal combustion engine. This type of movement of the valve bridge—to a position in which system stability or operation is jeopardized—will be referred to herein as "uncontrolled movement" and, as used herein, this state of the valve bridge of being in a position in which system stability or operation is jeopardized is referred to as an "uncontrolled state" of the valve bridge relative to the engine valves.

Given the potential for valve bridge jump, misalignment and associated detrimental effects on engine and valve actuation system operation and wear in prior art systems, solutions that prevent, minimize, accommodate or guide against uncontrolled states or positions of valve bridges (regardless of the cause) would represent a welcome addition to the art.

SUMMARY

According to an aspect of the disclosure, valve bridges may include constraints and guides for controlling and managing valve bridge motion variances during engine operation. Constraints contemplated by the disclosure include an e-foot collar adapted to surround the e-foot and an extended portion on the valve bridge adapted to fit between the valve springs. Guides contemplated by the disclosure include lead-in chamfers surround the valve pockets on the valve bridge for guiding the valve tips into the valve pockets when the valve bridge becomes misaligned and a deflecting surface on the extended portion for preventing the extended portion from catching on sharp corners or other features in the valve bridge environment. The disclosed constraining and guiding features prevent bridge jump or other bridge motion that would otherwise be uncontrolled and thus maintain the valve bridge in a controlled state throughout engine operation.

According to an aspect, the disclosure provides a valve bridge for use with an engine valve assembly of an internal combustion engine, the engine valve assembly comprising a plurality of engine valves, the internal combustion engine having a valve train for conveying motion from a motion source to the valve bridge, the valve train including an e-foot adapted to engage the valve bridge, the valve bridge comprising a central bridge housing; a locking assembly arranged in the central bridge housing and having an e-foot engagement surface, the locking assembly adapted to selectively lock or allow movement of the e-foot engagement surface relative to the central bridge housing to thereby convey or absorb motion; and the bridge further comprising a control surface arranged to contact the e-foot when the bridge would otherwise move to an uncontrolled state, the control surface thereby maintaining the bridge in a controlled state throughout engine operation. According to a further aspect, the control surface may be defined by a collar which may be circular, and which may completely or partially surround an e-foot engagement surface on the bridge. According to a further aspect, the e-foot engagement surface may be on a plunger or piston assembly arranged in a central bridge housing. According to a further aspect, the control surface may extend a sufficient distance from the central bridge housing to constrain movement of the valve bridge relative to the e-foot to maintain the bridge in a controlled state. According to a further aspect, the control surface may extend a sufficient distance from the central bridge housing to limit movement of the valve bridge through a maximum controlled displacement. According to a further aspect, the valve bridge may comprise a valve pocket defining a valve stem seat for receiving a valve stem tip and a lead-in surface adapted to guide the valve stem seat into alignment with the valve stem tip when the bridge would otherwise move to an uncontrolled position. According to another aspect, the lead-in surface may be a chamfer. According to a further aspect, the lead-in surface may extend a sufficient distance from the valve seat to guide the valve stem seat into alignment when a maximum bridge jump displacement would otherwise occur. According to a further aspect, a extended portion having at least one lower guide surface may be disposed proximate the central bridge housing and may have at least one lower guide control surface configured to limit bridge movement by engaging a valve spring assembly, including a valve spring and a valve spring retainer, which may be oversized, to maintain the bridge in a controlled state. According to a further aspect, the valve bridge may comprise a brake pin disposed in a brake pin bore to further constrain movement of the valve bridge. Moreover, according to one aspect, the disclosed constraining e-foot collar and extended portion provide constraints on, and thus define, a worst-case deviation in bridge position and this worst-case position can be used to configure the guiding surfaces, such as the lead-in chamfers to ensure that the lead-in chamfers catch and guide the valve bridge back to an aligned and controlled position for all possible errant movements that could occur. Thus, the valve bridge is maintained in a controlled position and valve bridge jump and errant, uncontrolled motion is prevented.

According to one aspect, a valve bridge may include an e-foot collar with a control surface that surrounds the e-foot to thereby constrain movement (translation, pitch, roll or yaw) of the valve bridge relative to the e-foot. According to an aspect, a valve bridge for use with an engine valve assembly of an internal combustion engine, the engine valve assembly comprising a plurality of engine valves, the internal combustion engine having a valve train for conveying motion from a motion source to the valve bridge, the valve train including an e-foot adapted to engage the valve bridge, the valve bridge may comprise: a central bridge housing; a locking assembly arranged in the central bridge housing and having an e-foot engagement surface, the locking assembly adapted to selectively lock or allow movement of the e-foot engagement surface relative to the central bridge housing to thereby convey or absorb motion; and the bridge further comprising a control surface arranged to contact the e-foot when the bridge would otherwise move to an uncontrolled state, the control surface thereby maintaining the bridge in a controlled state throughout engine operation.

According to another aspect, a valve bridge may include an extended portion on the bridge, the extended portion defining one or more control surfaces that are arranged and adapted to engage valve springs and/or valve spring retainers when the valve bridge position deviates from a controlled state to thereby constrain movement of the valve bridge.

According to another aspect, a valve bridge may include valve stem tip lead-in chamfers surrounding the valve pockets. The lead-in chamfers are configured to catch the valve stem tips at all possible positions of the valve bridge relative to the valve stem tips as defined by the constraints of the e-foot collar control surface and/or the extended portion control surface.

According to another aspect, a bridge brake pin may provide further constraint on the bridge motion in combination with the e-foot collar constraint. This configuration may be further combined with the extended portion constraint, the valve lead-in surfaces surrounding the valve bridge valve pockets and/or a deflection surface on a bridge extended portion, each feature used alone or in combination with one or more of the other features.

According to another aspect, the bridge extended portion may be provided with a deflection feature for preventing the bridge extended portion from catching on sharp corners or surfaces in the overhead engine environment during engine operation.

According to another aspect, a process for configuring valve bridge control surfaces includes evaluating extreme positions of a valve bridge in both locked and unlocked states, configuring an e-collar to constrain bridge movement, optionally configuring an extended portion control surface to constrain bridge movement, and optionally configuring valve tip lead in chamfers based on the constraints defined by the e-collar and/or extended portion.

BRIEF DESCRIPTION OF THE DRAWINGS

The foregoing and other features and advantages will be discussed in detail in the following non-limiting description of specific embodiments in connection with the accompanying drawings, in which.

DETAILED DESCRIPTION

Figure 1:
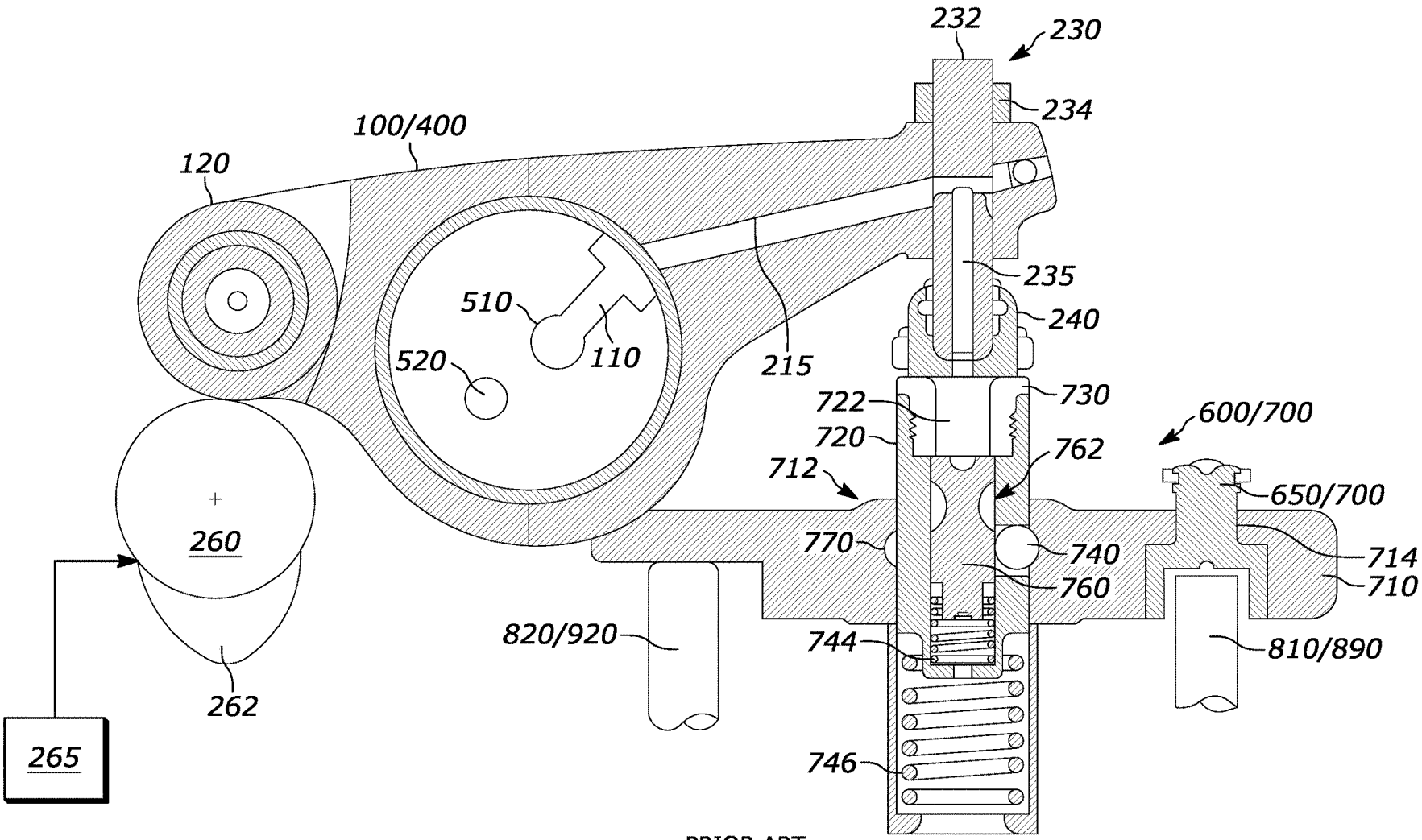
PRIOR ART FIG. 1
FIG. 1 is a cross-sectional illustration of a valve actuation system that includes a valve bridge having a locking mechanism in accordance with prior art.
Figure 2:
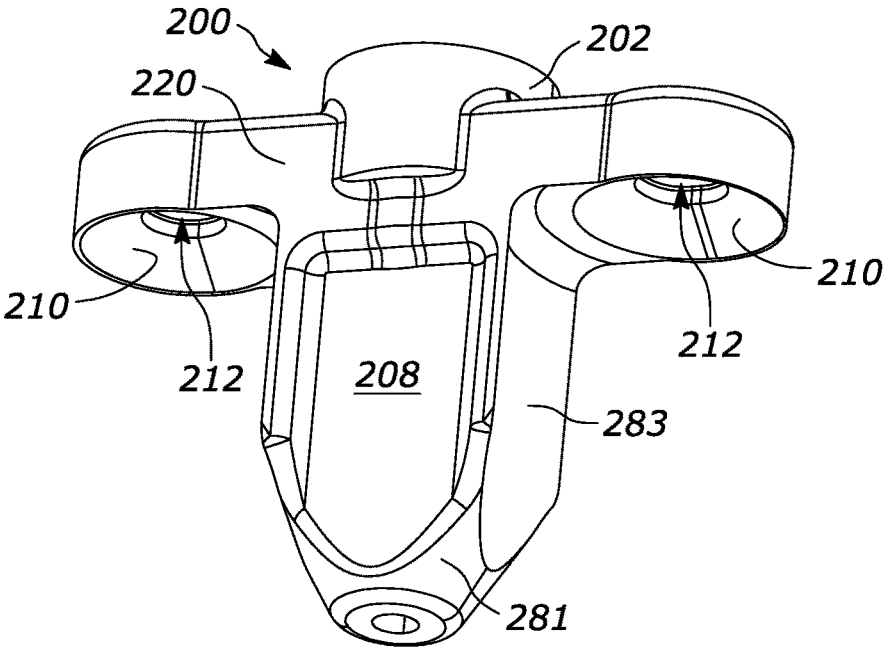
FIG. 2 is an illustration of a lower front perspective view of a valve bridge in accordance with the instant disclosure.
Figure 6:
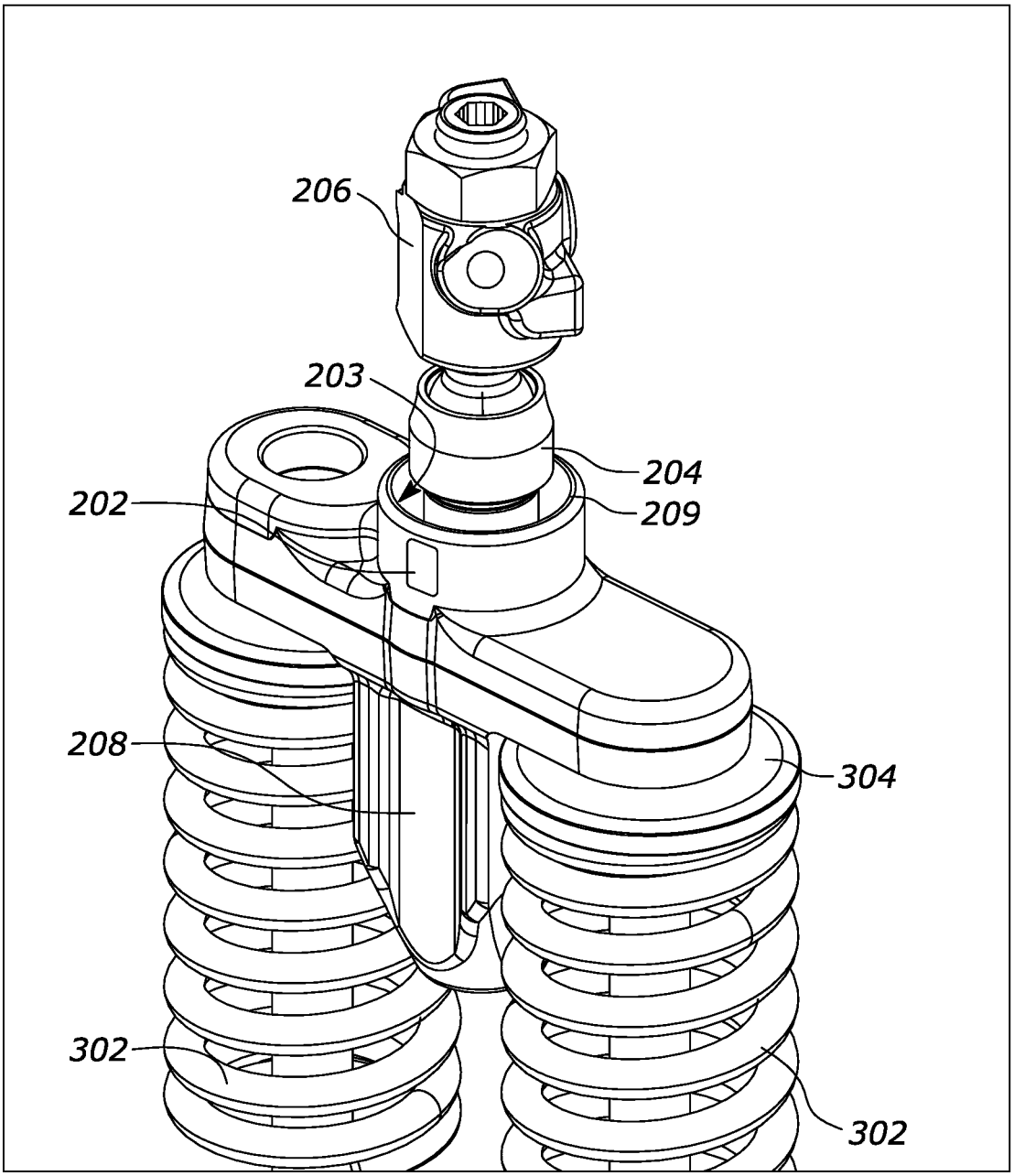
FIG. 6 is an illustration of a perspective view of the valve bridge of FIGS. 2-5 deployed in an internal combustion engine and in a controlled state.

With reference to FIGS. 2-6, a valve bridge 200 in accordance with the instant disclosure includes a guide feature in the form of a collar or vertically extending wall 202 that is adapted to interface with, and control, movement of the valve bridge 200 relative to an e-foot on the rocker arm. Referring particularly to FIG. 6, e-foot (also termed a swivel foot) 204 of a rocker arm 206 is adapted to engage the valve bridge 200 when the valve bridge 200 is deployed to an engine environment (i.e., installed). The collar 202 may extend upward from a main body portion 220 which may have a central bridge housing to house components of the bridge locking or collapsing mechanism 250. The collar 202 may define a control surface 203 on an interior thereof for constraining movement of the valve bridge 200 relative to the e-foot 204, thereby preventing uncontrolled movement of the valve bridge relative to the e-foot. Collar 202 may include one or more flattened areas on an outer surface thereof (FIG. 6) to provide clearance and/or constraint of the valve bridge movement relative to other engine components in the overhead environment. Collar 202 and the control surface 203 may completely surround an e-foot engagement surface 252, which may be disposed on a cap 254 of the locking assembly or mechanism 250 in a manner that is similar to cap 730 described in the context of FIG. 1. As will be recognized, variations on the continuous surface shown in this example are contemplated by the instant disclosure, for example, intermittent or discontinuous surfaces extending upward and surrounding the e-foot engagement surface. For example, the collar need not be a complete, continuous circular feature. There may be intermittent walls with slots or spaces between them, forming a number of control surfaces surrounding the e-foot. The slots or spaces may be dimensioned such that the e-foot is prevented from passing laterally through the slots or spaces.

Figure 3:
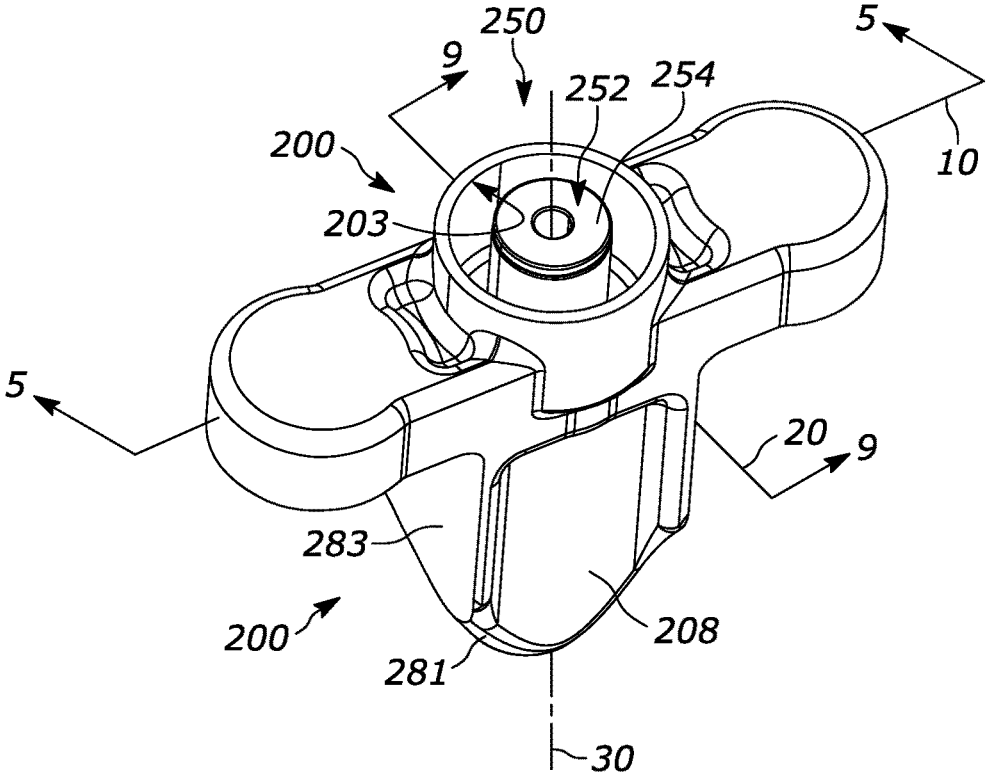
FIG. 3 is an illustration of an upper front perspective view of a valve bridge in accordance with the instant disclosure.
Figure 4:
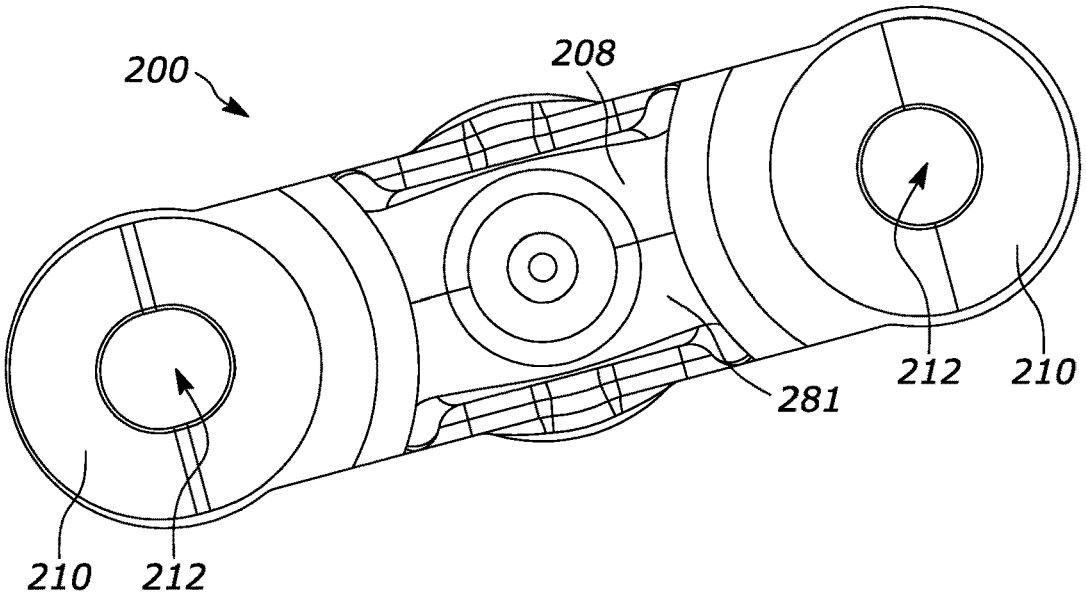
FIG. 4 is a bottom view of the valve bridge of FIGS. 2 and 3.
Figure 5:
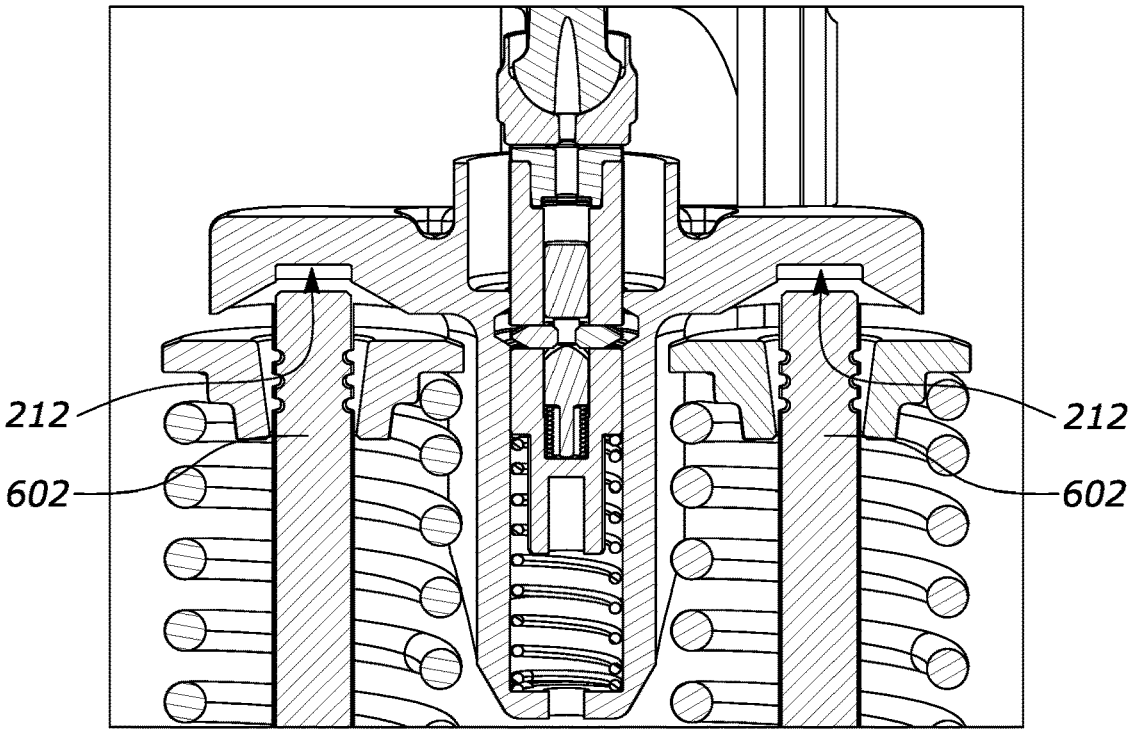
FIG. 5 is a cross-sectional view of a valve bridge (along section line 5-5 in FIG. 3) showing the valve bridge in a partially jumped condition.

FIG. 3 illustrates an isometric top front view of the example bridge 200. FIG. 3 also illustrates a three-dimensional reference space defined by three axes and useful for understanding bridge movement in the context of this disclosure: a longitudinal axis 10 extending through locking mechanism (center of central bridge housing) and the valve stem pockets; a lateral axis 20 extending orthogonally to the longitudinal axis 10 and through the locking mechanism; and a vertical axis 30 extending orthogonally to both the longitudinal axis 10 and the lateral axis 20. This reference space provides a frame of reference for describing the various bridge movements that the constraining features of the instant disclosure may restrict or accommodate. As will be appreciated from this disclosure, bridge jump and the corresponding tendency of the bridge to move towards an uncontrolled state may involve one or more of translation, rotation, pitch, roll or yaw relative to one or more of these three axes. For example, bridge jump may involve translation of the valve bridge 200 upward along the vertical axis, as well as pitch of the valve bridge 200 relative to the longitudinal axis (i.e., with pitch causing one valve step pocket to elevate higher than the other valve stem pocket), as well as roll about the longitudinal axis (i.e., with roll causing rotation of the valve bridge about the longitudinal axis). In accordance with this disclosure, motion of the valve bridge may be constrained to prevent or accommodate any one or a combination of these motions to an extent that maintains the valve bridge in a controlled state, or, put another way, prevents the valve bridge from moving to what would otherwise be an uncontrolled state.

Figure 7:
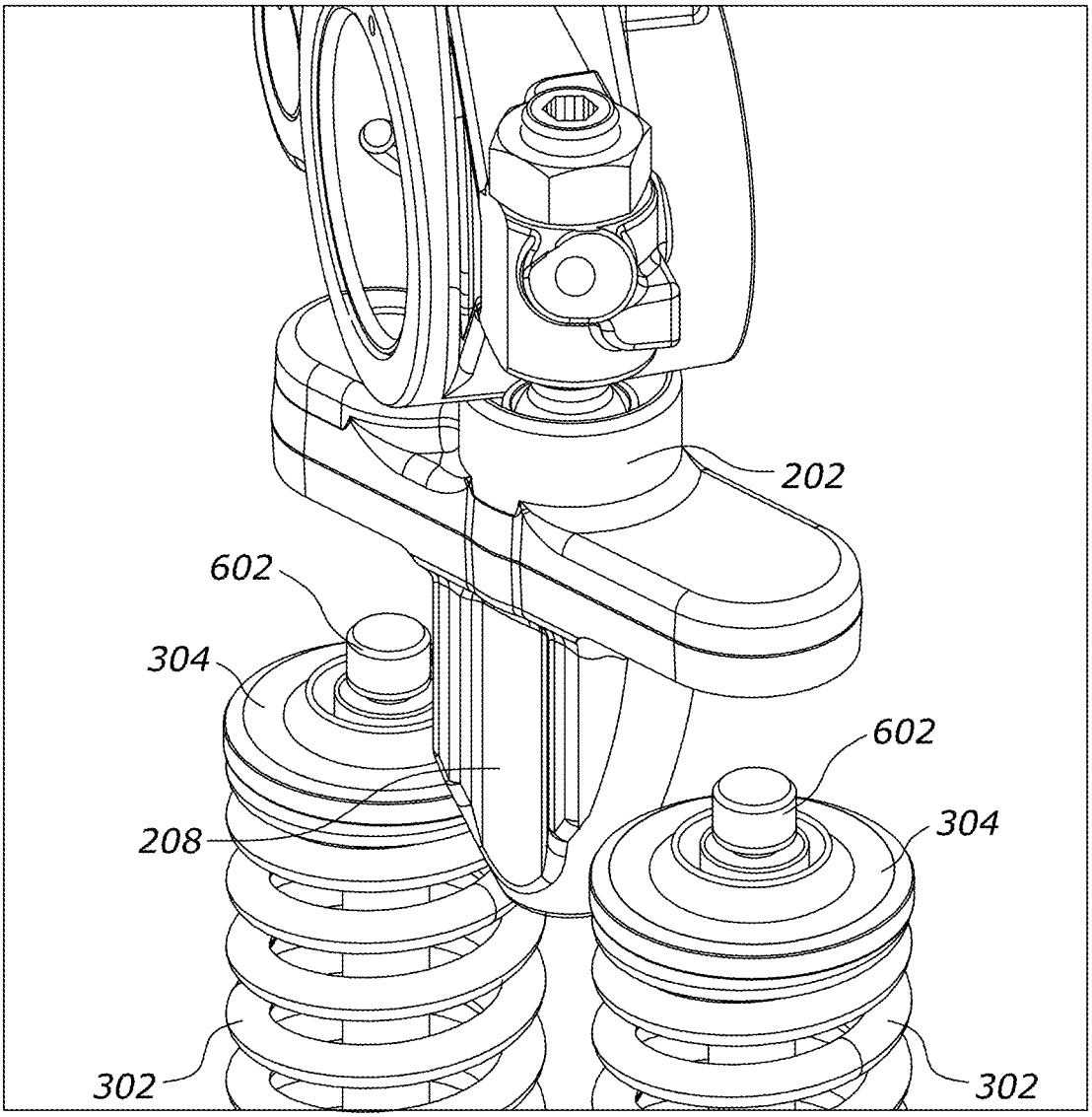
FIG. 7 is an illustration of a perspective view of the valve bridge of FIGS. 2-6 deployed in an internal combustion engine and in an uncontrolled state in which the bridge is separated from the valve tips.

As shown in FIG. 6, the vertical extent or height of the collar 202 may be configured to provide that, during a controlled state operation of the valve bridge 200 as shown in FIG. 6, when the locking mechanism is locked in place and at a maximum height or stroke relative to the valve bridge main body portion 220, the bottom surface e-foot 204 is positioned above a terminal edge 209 of control surface 203. Such a configuration may facilitate easy installation and removal of the bridge 200, for example. Moreover, the vertical extent or height of the collar 202 is such that, during a collapsed or unlocked state of the locking assembly or mechanism 250 included in the valve bridge 200, the e-foot 204 may translate into the space delimited by the collar 202 and control surface 203. The control surface 203 is also dimensioned (i.e., has sufficiently large diameter) to be free from engagement with the e-foot during normal, controlled movement of the valve bridge 200. However, the control surface 203 is also dimensioned (i.e., has sufficiently small diameter) to provide for engagement of the control surface 203 with the e-foot 204 when the valve bridge moves towards an uncontrolled position relative to the e-foot. That is, during movement, such as horizontal or vertical translation, pitch, roll or yaw of the valve bridge towards an uncontrolled state or position relative to the e-foot, the collar 202 may surround and operate to contact the e-foot 204 (regardless of the collapsed/un-collapsed or locked/unlocked state of the collapsing mechanism), thereby limiting any translation or other movement of the valve bridge 200 and maintaining the valve bridge 200 in a controlled state. This is illustrated in FIG. 7 where movement of the valve bridge towards an uncontrolled position or state has brought the valve bridge out of contact with the engine valve stems 602, for example. However, as shown in both FIGS. 6 and 7, the collar 202 is configured to have sufficient vertical extent to contact the e-foot 204 when the valve bridge would otherwise move to an uncontrolled state or position relative to the e-foot, and thereby reduce any tilting or misalignment of the valve bridge.

In accordance with other aspects of the disclosure, as shown in FIGS. 6 and 7, the valve bridge 200 may include an additional guide feature in the form of an extended portion 208 (FIG. 2) having control surfaces 283 and configured to extend between but in close proximity to engine valve springs 302 and/or engine valve spring retainers 304. Examples of various embodiments of such an extended portion are described in U.S. Pat. Nos. 10,883,392, 11,053,819 and 11,319,842, the disclosures and subject matter of which are incorporated by reference herein in their entirety. As described in these documents, the extended portion 208 is configured to remain out of contact with the valve springs 302 and/or retainers 304 during controlled operation of the valve bridge 200 but configured to contact the valve springs 302 and/or retainers 304 when the valve bridge moves towards an uncontrolled position, thereby limiting tilting/rotation or other undesired movement of the valve bridge 200 towards an uncontrolled state. The extended portion 208 may be provided with a tapered and/or conical deflection surface 281 (FIGS. 2 and 3) at an end thereof. This feature prevents the bridge extended portion 208 from catching on corners or other sharp features in the overhead environment (i.e., in proximity to the space between valve springs where the extended portion 208 is typically located) when the bridge 200 undergoes a jump or movement towards an uncontrolled position. Deflection surface 281 thus prevents an uncontrolled position of the bridge 200 and guides the bridge 200 back to a controlled position in the event of a deviation from a controlled state or position.

Figure 8A:
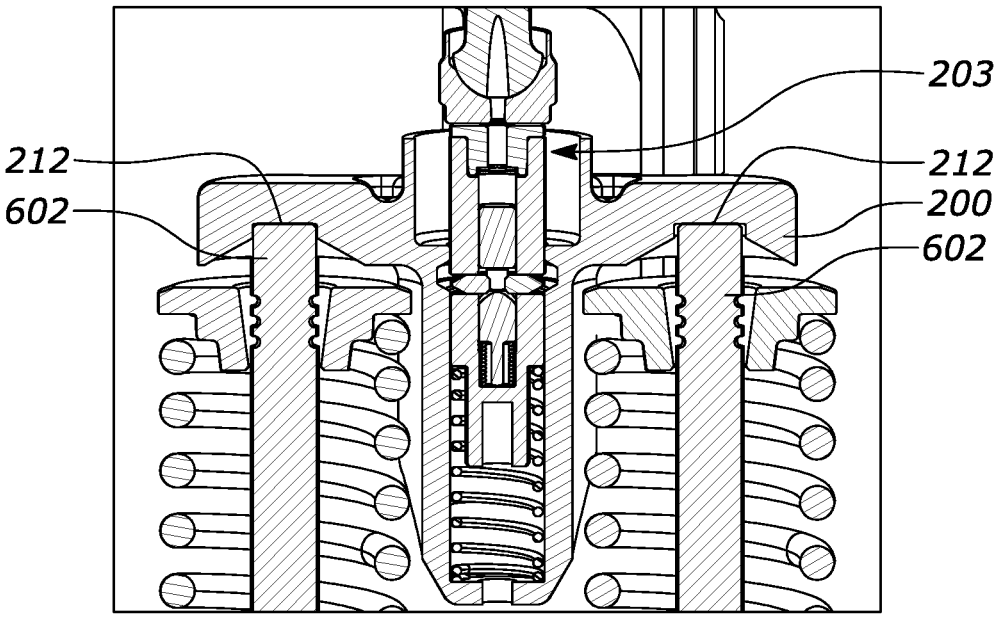
FIGS. 8A-8C are cross-sectional illustrations of the valve bridge of FIGS. 2-7 showing a sequence of a bridge jump condition or event.
Figure 8B:
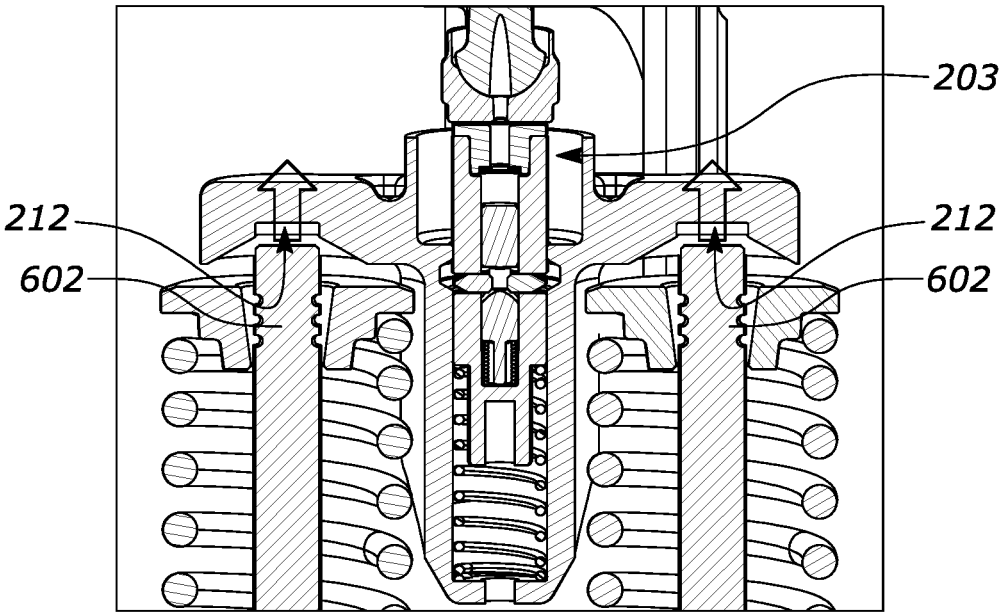
Figure 8C:
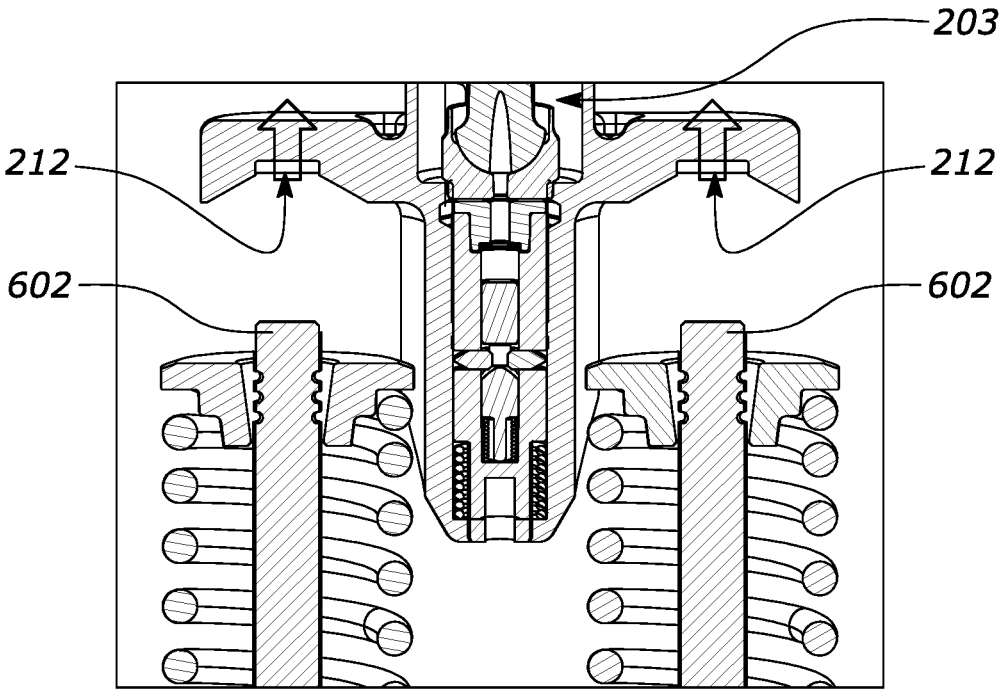
Figure 9:
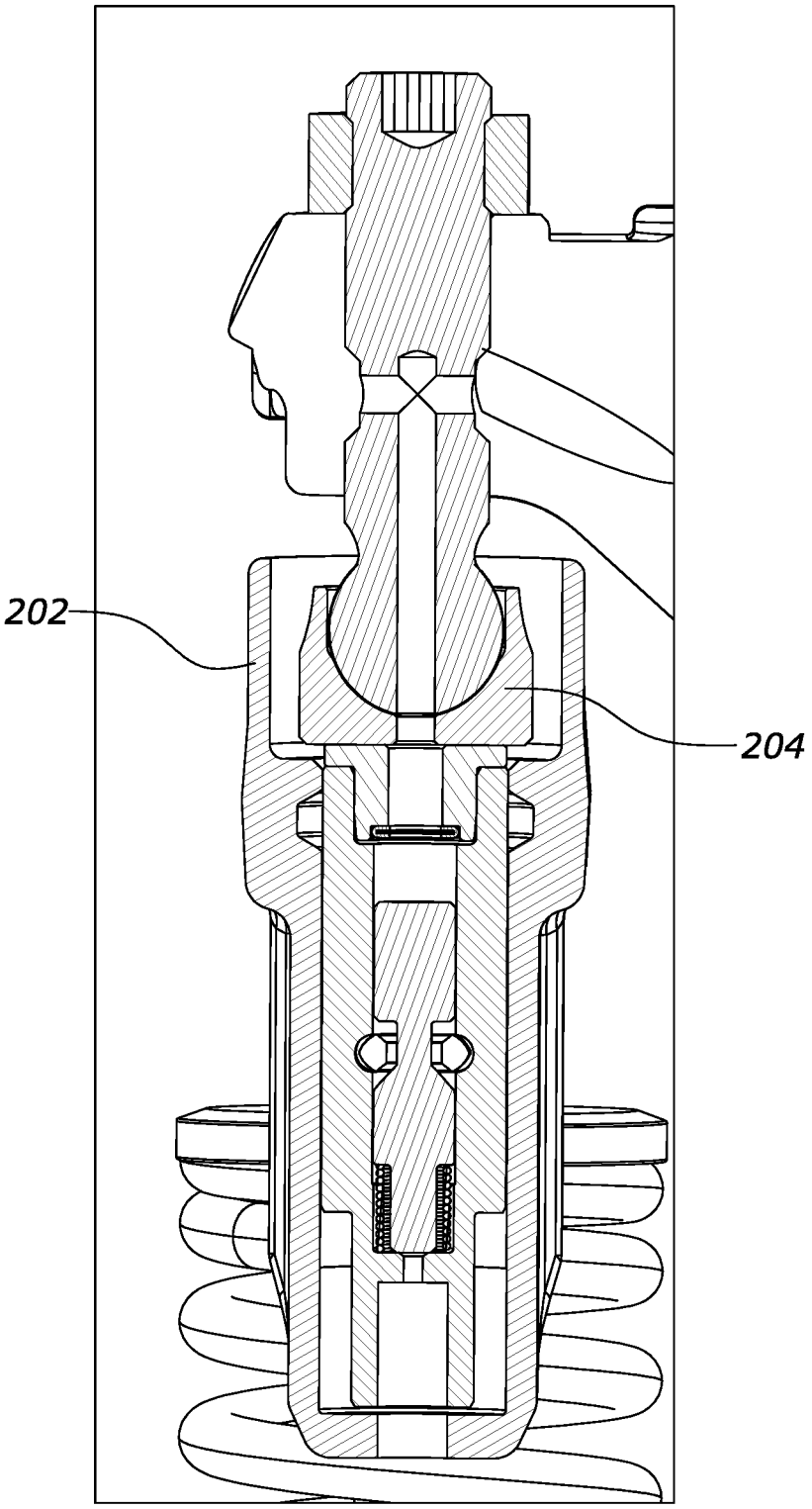
FIG. 9 is a partial cross-sectional illustration the valve bridge (along line 9-9 in FIG. 3) with the valve bridge at a peak jump height.

FIGS. 8A-8C illustrate a sequence of a valve bridge jump for a valve bridge having the guiding features described. In FIG. 8A, the bridge 200 is in a controlled position relative to the valve stem tips 602, with each valve stem tip 602 being aligned with and seated within a valve tip pocket 212. Here, the bridge locking mechanism is locked in an extended position relative to the bridge 200. FIG. 8B shows the beginning of a bridge jump condition in which the bridge 200 becomes displaced from the valve stem tips 602. This may occur when there is slippage in the locking mechanism resulting from partial engagement of the locking mechanism locking elements. As a result, and owing to the valve spring forces, the valve stem tips 602 may snap upward abruptly as the valves slam closed against their respective valve seat. Such action may jettison the valve bridge upward and cause the valve bridge to displace from the valve tips. FIG. 8C shows the full extent of a possible bridge jump with the upper limit being reach as the locking mechanism collapses to its internal limit within the valve bridge central housing. FIG. 9 is another cross-sectional view showing the position of an e-foot within the collar at a peak jump height.

As will be appreciated, while the illustrated bridge jump is a pure translation upward and involves the valve tip pockets 212 being equidistant from their respective valve stem tip 602, it will be appreciated from the instant disclosure, that the constraint and guide features described herein may alleviate or accommodate (guide against) other undesirable bridge motion, such as pitch of the valve bridge 200 relative to the longitudinal axis in which case one of the valve tip pockets 212 would be further from its respective valve stem tip 602 than the other valve pocket 212. Collar 202 and control surface 203 would thus restrict pitch of the valve bridge relative to the longitudinal axis since control surface 203 would encounter the e-foot before the bridge pitched to an uncontrolled position. Collar 202 and control surface 203 are also configured to prevent roll of the valve bridge 200 relative to its longitudinal axis. As will be recognized, such motion can also be viewed as pitch of the valve bridge 200 relative to its lateral axis.

Figure 10B:
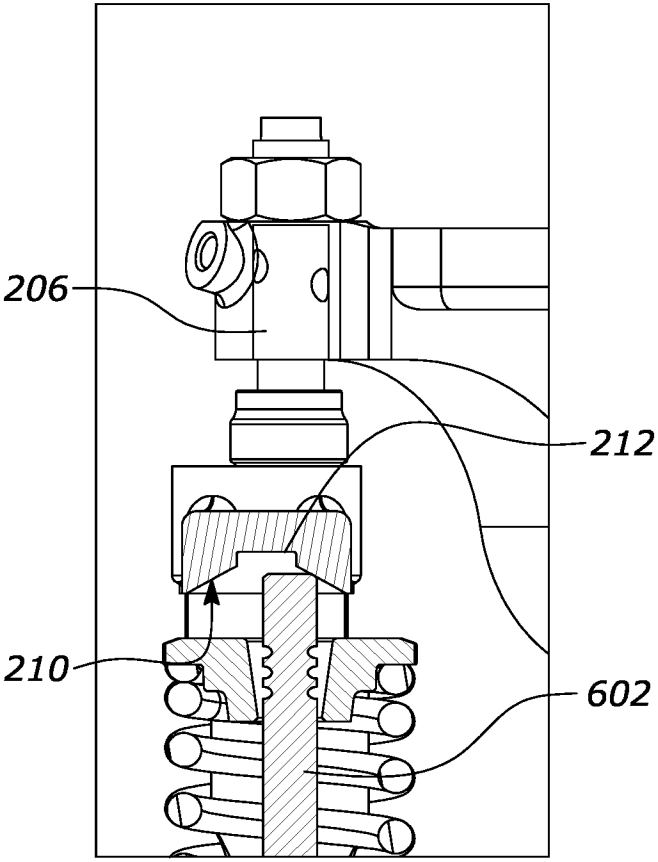
FIGS. 10A-10D illustrate in partial cross-section a sequence in which a valve tip lead in chamfer in accordance with the instant disclosure maintains a valve bridge in a controlled state.
Figure 10A:
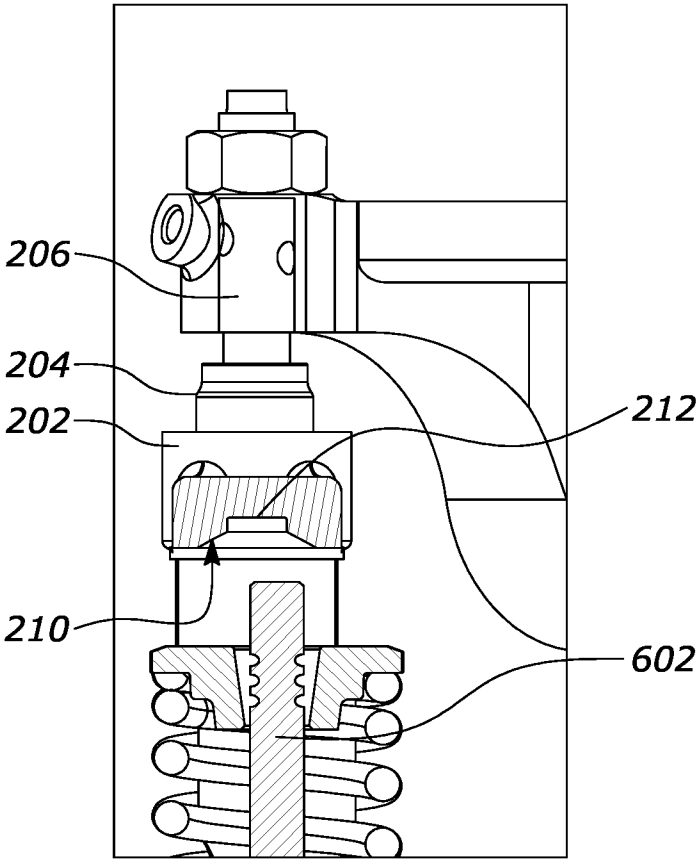
Figure 10D:
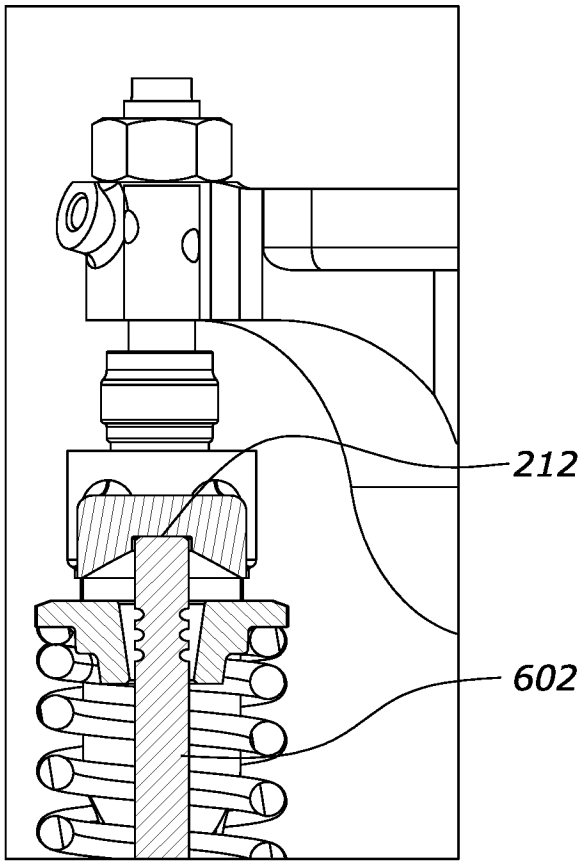
Figure 10C:
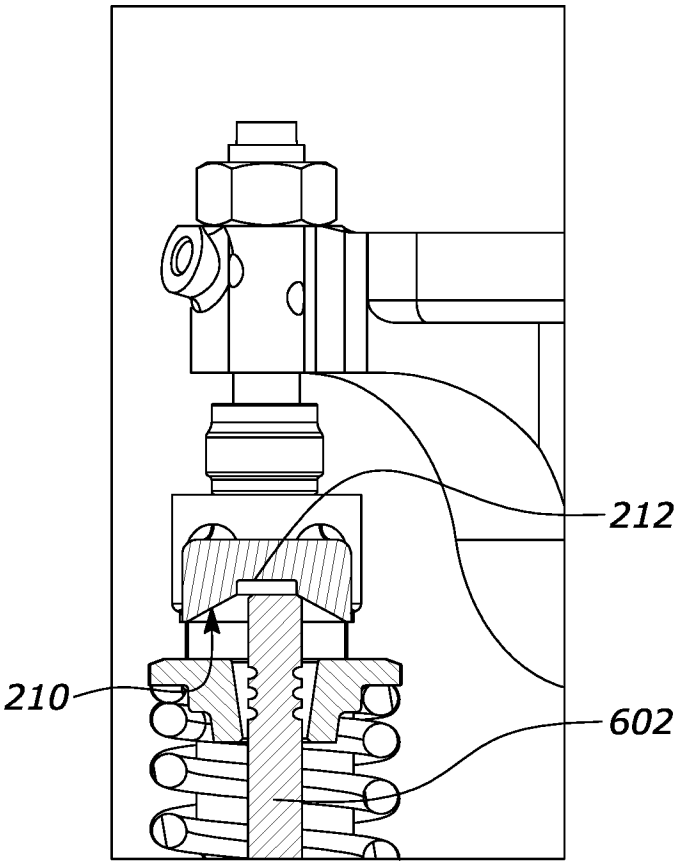

According to aspects of the disclosure, valve bridges may also be provided with guiding features that accommodate movement toward an uncontrolled state or position (relative to the valve tips) and guide the valve bridge back towards a controlled state or position (relative to the valve tips). Referring again to FIGS. 2-9 and 10A-10D, the valve bridge 200 may include control surfaces in the form of lead-in chamfers 210 that substantially surround the valve tip pockets 212. The lead-in chamfers 210 are each configured and adapted to receive a respective engine valve stem 602 and guide the valve stem 602 back into the valve pockets when misalignment or movement of the valve bridge towards an uncontrolled position relative to one or both of the valve stems 602 occurs. FIGS. 10A-10D illustrate in cross-section a sequence in which a jumped valve bridge 200 is guided back to a controlled state. The lead-in chamfer 210 at each valve tip pocket 212 is large enough to interface with an outer diameter of the tip of valve stem 602 when movement of the valve bridge 200 is at a worst-case deviation from the controlled position (i.e., one or more or a combination of the translation, pitch, roll and yaw). The lead in chamfers 210 are configured to guide the valve bridge 200 back onto one or both of the valve tips following a bridge jump, misalignment, or other event in which the valve bridge would tend to move towards an uncontrolled position. Starting at FIG. 10A, the valve bridge 200 is moving towards an uncontrolled state as a result of the valve tip pocket 212 coming out of contact with the valve stem tip 602. Moreover, the valve tip pocket 212 may also become misaligned with the valve stem tip 602 due to bridge translation, or yaw (about the vertical axis) as also shown in FIG. 10A. As will be recognized, the valve bridge 200 may also undergo roll or pitch. In accordance with aspects of the disclosure, as also shown in FIG. 10A, the bridge 200 is constrained against excessive translation (i.e., along the lateral and longitudinal axes) as well as excessive roll (about the longitudinal axis) by the collar 202 contacting the e-foot 204, thereby limiting the errant, uncontrolled motion of the valve bridge 200. This constraint, in turn, also limits misalignment of the valve tip pocket 212 relative to the valve stem tip 602. In FIG. 10B, the valve bridge 200 may move into a position in which it contacts the valve stem tip 602 (where, for example, rotation of the rocker arm 206 and/or stroke or locking of the locking mechanism) forces the valve bridge 200 toward the engine valves). In this example, the lead-in chamfer 210 contacts an outer edge of the valve stem tip 602. As shown in FIGS. 10C and 10D, the sloped configuration of the lead-in chamfer 210, combined with the continued contact between the outer diameter of the valve stem tip 602, urges the valve bridge 200 to rotate/translate or otherwise return to a position in which the valve tip pocket 212 is in alignment with valve stem tip 602.

Figure 11:
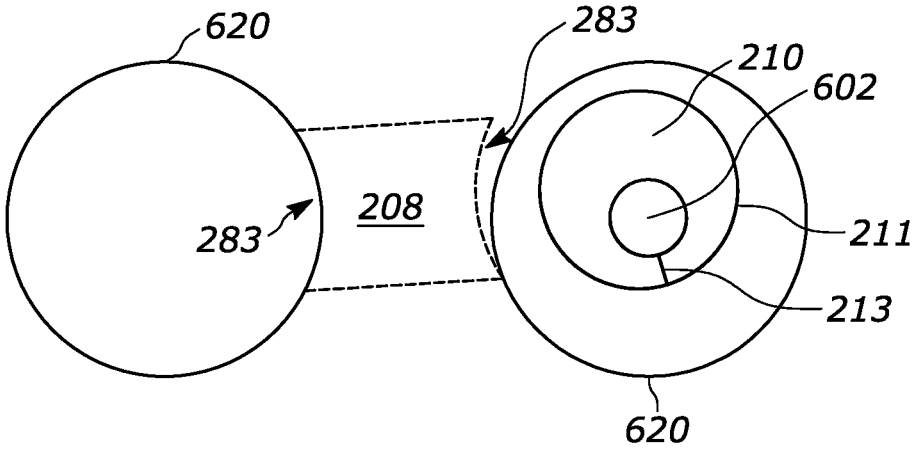
FIG. 11 is a schematic illustration of a lead-in chamfer configuration and example bridge constraint geometry in accordance with the instant disclosure.

FIG. 11 is a schematic showing geometrical representations of a bottom view of an example lead-in chamfer 210 configuration superimposed on representations of the valve spring outer circumference 620 and a cross-section of an example valve bridge extended portion 208 with control surfaces 283. In accordance with aspects of the disclosure, the dimensions of the valve bridge lead-in chamfer, such as the diameter of a lead-in chamfer edge circle 211 may be configured to accommodate a determined maximum movement of the valve bridge relative to the valve stem tips. In accordance with aspects of the disclosure, this determined maximum movement may be defined by the constraints provided by the control surface 203 on collar 202 and/or the control surfaces on extended portion 208. In this example, a maximum yaw (about the vertical axis extending into the page) of the extended portion 208 is determined based on the point of engagement of the extended portion 208 with the valve spring 620 outer circumference, or in an alternative constraint configuration, with the valve spring retainer (304 in FIG. 6) when the valve spring retainer is made with an outer circumference that is larger than the spring outer circumference The extent (in this case a diameter) of the lead-in chamfer 210 may be selected to accommodate this maximum movement and may also include an allowance for additional clearance 213. Thus, in accordance with aspects of the disclosure, the maximum (worst-case) movement (translation, pitch, roll, yaw relative to the longitudinal, lateral and vertical axes) of the valve bridge 200 relative to the valve stem tips 602 may be defined based on the above-described constraints, namely, the collar control surface and the extended portion control surface(s). Then, the lead-in chamfer(s) may be configured to accommodate the determined maximum movement, with some allowance for variation. Stated another way, the lead-in chamfer is configured to be large enough to catch and guide the valve stem tip at all possible positions of the bridge relative to the valve stem tip as defined by the constraint features on the valve bridge, namely, the extended portion control surface(s) 283 and/or the collar control surface 203. In this manner, valve bridges can be readily configured to prevent bridge jump and uncontrolled operation.

While the embodiment of the valve bridge 200 shown in FIGS. 2-6 and described herein illustrates the combination of the collar 202, extended portion 208 and lead-in chamfers 210, it is understood that all three of these features do not need to be included in all implementations of valve bridges in accordance with the instant disclosure. That is, rather than combining all three of these features, the collar 202 could be implemented as a single feature or in combination with either the extended portion 208 or the lead-in chamfers 210. Furthermore, though these three features have been illustrated in the context of a valve bridge comprising a collapsing mechanism, it is noted that this is not a requirement. That is, it is understood that these features (once again, individually, collectively or in sub-combinations thereof) may be equally employed in valve bridges that do not incorporate a collapsing mechanism.

Figure 12:
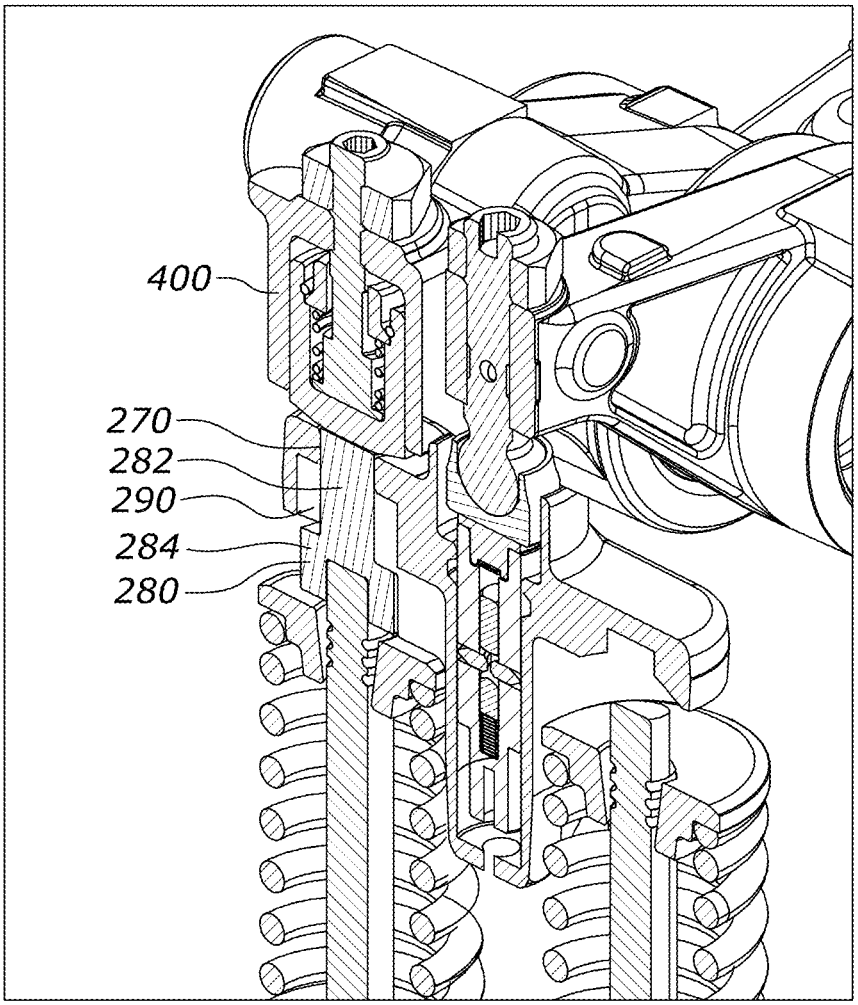
FIG. 12 illustrates a cutaway view of a braking pin and e-foot collar constraint configuration in accordance with an aspect of the instant disclosure.

FIG. 12 illustrates another constraining configuration in accordance with aspects of the disclosure. In this example, a bridge brake pin 280 may be used in conjunction with collar 203 to provide an additional constraint on bridge movement. Bridge brake pin 280 may have a first diameter portion 282 extending through a bore 270 and arranged to engage a braking piston assembly 400. A brake pin base 284 may have a larger diameter than the first diameter portion 282 and may be disposed within a counterbore 290 in the bridge. The dimensions of the brake pin base 284 and the first diameter portion 282, as well as the dimensions of bore 270 and counterbore 290 can be configured to provide a determined constraint on movement of the valve bridge 200 during a braking operation or during other events. As will be recognized, the brake pin feature may provide a constraint on translation and yaw (about the vertical axis) which augments the constraint on motion provided by the collar 203, thereby providing improved control of valve bridge motion and preventing bridge jump and uncontrolled movement during engine operation.

Figure 13:
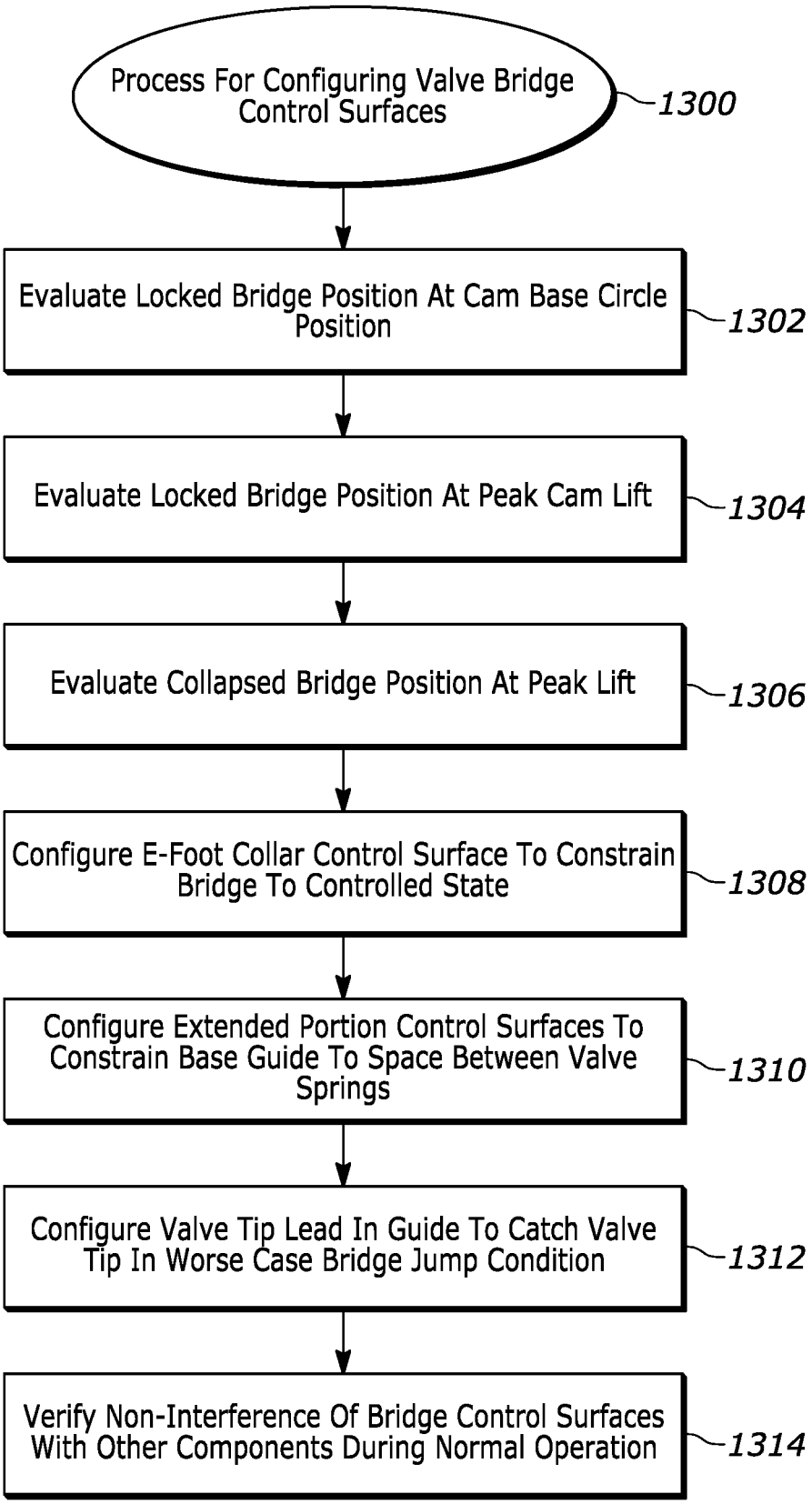
FIG. 13 illustrates an example method or process for configuring valve bridge control surfaces in accordance with the instant disclosure.

FIG. 13 illustrates a process 1300 for configuring bridge constraints and guides in accordance with the instant disclosure. At 1302, the position of the locked bridge (relative to the valve stem tips) at cam base circle is evaluated. At 1304, the position of the locked bridge at peak cam lift is evaluated. At 1306, the position of the fully collapsed bridge is evaluated. At 1308, the e-foot collar control surface(s) is(are) configured to constrain the bridge movement to a controlled state. At 1310, the extended portion control surfaces are configured. At 1312, the valve tip lead-in control surfaces (guides) are configured based on worst-case bridge movement as determined based on the evaluations at steps 1302 to 1310. At 1314, non-interference of the bridge control surfaces with other components in the overhead environment during normal engine operation may be verified.

Although the present implementations have been described with reference to specific example embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. A valve bridge for use with an engine valve assembly of an internal combustion engine, the engine valve assembly comprising a plurality of engine valves, the internal combustion engine having a valve train for conveying motion from a motion source to the valve bridge, the valve train including an e-foot adapted to engage the valve bridge, the valve bridge comprising:

a central bridge housing;

a locking assembly arranged in the central bridge housing and having an e-foot engagement surface, the locking assembly adapted to selectively lock or allow movement of the e-foot engagement surface relative to the central bridge housing to thereby convey or absorb motion; and the bridge further comprising a control surface arranged to contact the e-foot when the bridge would otherwise move to an uncontrolled state, the control surface thereby maintaining the bridge in a controlled state throughout engine operation.

2. The valve bridge of claim 1, wherein the control surface completely surrounds the e-foot engagement surface.

3. The valve bridge of claim 1, wherein the control surface is defined by a collar extending around the e-foot engagement surface.

4. The valve bridge of claim 3, wherein the collar is circular.

5. The valve bridge of claim 1, wherein the e-foot engagement surface is on a plunger or piston assembly arranged in the central bridge housing.

6. The valve bridge of claim 1, wherein the control surface extends from the central bridge housing towards the e-foot so as to constrain movement of the valve bridge relative to the e-foot.

7. The valve bridge of claim 1, wherein the e-foot engagement surface is formed on a plunger of the locking assembly, the plunger adapted to move a stroke length within the central bridge housing in an unlocked state, and wherein the control surface extends from the central bridge housing towards the e-foot so as to limit movement of the valve bridge relative to the e-foot throughout the stroke length of the plunger.

8. The valve bridge of claim 1, further comprising a valve pocket for receiving a valve stem tip, the valve pocket defining a valve stem seat, the valve pocket further comprising a lead-in surface adapted to guide the valve stem seat into alignment with the valve stem tip when the bridge and valve stem seat would otherwise move to an uncontrolled position.

9. The valve bridge of claim 8, wherein the lead-in surface is a chamfer.

10. The valve bridge of claim 8, wherein the lead-in surface is configured to prevent a maximum bridge jump displacement between the valve stem seat and valve stem tip from occurring.

11. The valve bridge of claim 1, further comprising an extended portion disposed proximate the central bridge housing and having at least one lower guide control surface that is configured to limit bridge movement by engaging a valve spring assembly to thereby maintain the bridge in a controlled state.

12. The valve bridge of claim 11, wherein the lower guide control surface is configured to engage a valve spring.

13. The valve bridge of claim 11, wherein the lower guide control surface is configured to engage an oversize valve spring retainer.

14. The valve bridge of claim 11, wherein the lower guide surface is configured to be clear of contact with the valve spring assembly when the valve bridge is in a controlled state and wherein lower guide surface is configured to contact valve spring assembly so as to retain the valve bridge.

15. The valve bridge of claim 1, further comprising a brake pin disposed within a brake pin bore in the valve bridge.

16. The valve bridge of claim 15, wherein the brake pin is configured to constrain relative movement of the brake pin and bridge to maintain the valve bridge in a controlled state.

17. The valve bridge of claim 15, wherein the bridge further comprises a brake pin base receptacle for receiving a base of the brake pin, wherein the brake pin base receptacle and brake pin base are configured to constrain relative movement of the brake pin base and brake pin base receptacle to maintain the valve bridge in a controlled state.

18. The valve bridge of claim 1, further comprising a valve pocket lead-in chamfer configured to capture a valve tip at all valve bridge positions within a range of movement of the valve bridge as defined by the control surface.

19. The valve bridge of claim 1, further comprising an extended portion adapted to engage at least two valve springs via an extended portion control surface defining a range of movement of the valve bridge relative to at the least two valve springs; and a valve pocket lead-in chamfer configured to capture a valve tip at all valve bridge positions within the range of movement of the valve bridge.

20. The valve bridge of claim 1, further comprising a brake pin adapted to constrain movement of the valve bridge and further comprising a lead-in surface for guiding the valve bridge relative to a valve stem.

21. The valve bridge of claim 20, wherein the control surface comprises a collar adapted to at least partially surround and constrain movement of the valve bridge relative to the e-foot.

22. A process for configuring valve bridge control surfaces comprising:

evaluating extreme positions of a valve bridge in both locked and unlocked states;

forming an e-foot collar on the valve bridge, the e-foot collar being configured to constrain bridge movement and arranged to contact an e-foot when the bridge would otherwise move to an uncontrolled state, the e-foot collar thereby maintaining the bridge in a controlled state throughout engine operation; and forming a valve tip lead in surface on the valve bridge, the valve tip lead in surface being configured based on the constraints defined by the e-foot collar.

23. The process of claim 22, further comprising configuring an extended portion control surface on the valve bridge to constrain bridge movement.

24. The process of claim 23, further comprising configuring the valve tip lead in surface based on the constraints defined by the extended portion control surface.

* * * * *